US006132125A

United States Patent [19]

Lin

[11] Patent Number: 6,132,125

[45] Date of Patent: Oct. 17, 2000

[54] COMBINATION BUBBLE BLOWER PEN

[76] Inventor: Mon-Sheng Lin, 5th Fl., No. 4, Lane 7, Pao Kao Road, Hsintien, Taipei Hsien, Taiwan

[21] Appl. No.: 09/505,995

[22] Filed: Feb. 17, 2000

[51] Int. Cl.[7] ..... B43K 29/00

[52] U.S. Cl. ..... 401/195; 401/52; 401/17; 446/16

[58] Field of Search ..... 401/195, 52, 34, 401/99, 109, 110, 111, 112, 115, 117, 16–21, 24; 446/16

[56] References Cited

U.S. PATENT DOCUMENTS

| | | | |
|---|---|---|---|
| D. 336,659 | 6/1993 | Lin | D19/36 |
| 1,209,691 | 12/1916 | Elliott et al. | 401/17 |
| 2,323,302 | 7/1943 | Block | 401/21 |
| 5,425,591 | 6/1995 | Contreras et al. | 401/117 |
| 5,839,936 | 11/1998 | Lin | 446/16 |
| 6,004,597 | 12/1999 | Coleman et al. | 401/195 |

*Primary Examiner*—Henry J. Recla
*Assistant Examiner*—Tuan Nguyen
*Attorney, Agent, or Firm*—Dougherty & Troxell

[57] ABSTRACT

A combination bubble blower pen includes a pen body, an upper barrel connected to a top end of the pen body and holding a solution for producing bubbles, and a bubble-blowing device for insertion into the upper barrel to take the solution for blowing bubbles, the pen body having a penholder, a tapered front socket connected to the bottom end of the penholder, a writing element holder mounted in the penholder and fixedly connected to the front socket, and a writing element inserted into the writing element holder, the upper barrel having a receptacle extended from a bottom extension rod thereof and coupled to the top open head of the writing element holder, and a bellows tube connected between a bottom end of the body thereof and the top end of the penholder for enabling the upper barrel to be moved relative to the penholder to depress the top open end of the writing element holder in propelling the writing element out of the front socket for writing.

1 Claim, 7 Drawing Sheets

COMBINATION BUBBLE BLOWER PEN

BACKGROUND OF THE INVENTION

The present invention relates to a combination bubble blower pen, and more particularly to such a combination bubble blower pen, which combines an automatic pen (or mechanical pencil) and a bubble blower into a combination apparatus.

Various combination bubble blower pens have been disclosed, and have appeared on the market. These combination bubble blower pens commonly comprise a pen, and a bubble blower fastened to the top end of the pen. Due to fixed connection arrangement between the pen and the bubble blower, an automatic pen or mechanical pencil cannot be used in this case unless a special design is provided. Further, the bubble blower according to conventional bubble blower pens has a big diameter greater than the body of the pen.

SUMMARY OF THE INVENTION

The present invention has been accomplished under the circumstances in view. It is the main object of the present invention to provide a combination bubble blower pen, which combines an automatic pen/mechanical pencil and a bubble blower into a combination apparatus. It is another object of the present invention to provide a combination bubble blower pen, which keeps the periphery of the bubble blower and the periphery of the pen in flush. To achieve these and other objects of the present invention, there is provide a combination bubble blower pen, which comprises a pen body, an upper barrel connected to the top end of the pen body and holding a solution for producing bubbles, and a bubble-blowing device for insertion into the upper barrel to take the solution for blowing bubbles, the pen body having a penholder, a tapered front socket connected to the bottom end of the penholder, a writing element holder mounted in the penholder and fixedly connected to the front socket, and a writing element inserted into the writing element holder, the upper barrel comprising a receptacle extended from a bottom extension rod thereof and coupled to the top open head of the writing element holder, and a bellows tube connected between the bottom end of the body thereof and the top end of the penholder around the bottom extension rod and the receptacle for enabling the upper barrel to be moved relative to the penholder to depress the top open end of the writing element holder in propelling the writing element out of the front socket for writing.

DETAILED DESCRIPTION OF THE PREFERRED EMBODIMENT

Figure 1:
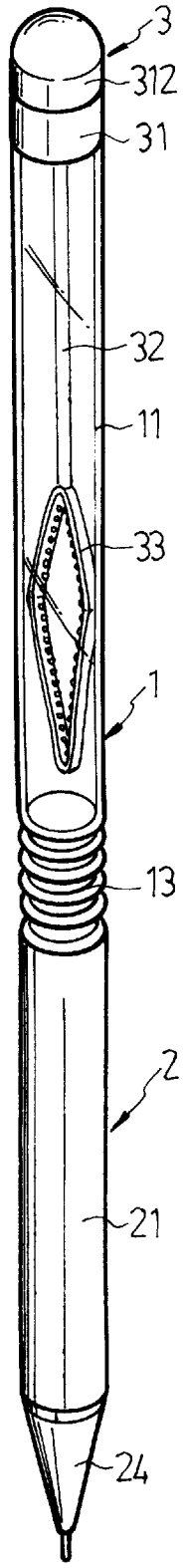
FIG. 1 is a perspective assembly view of a combination bubble blower pen according to a first embodiment of the present invention.
Figure 3:
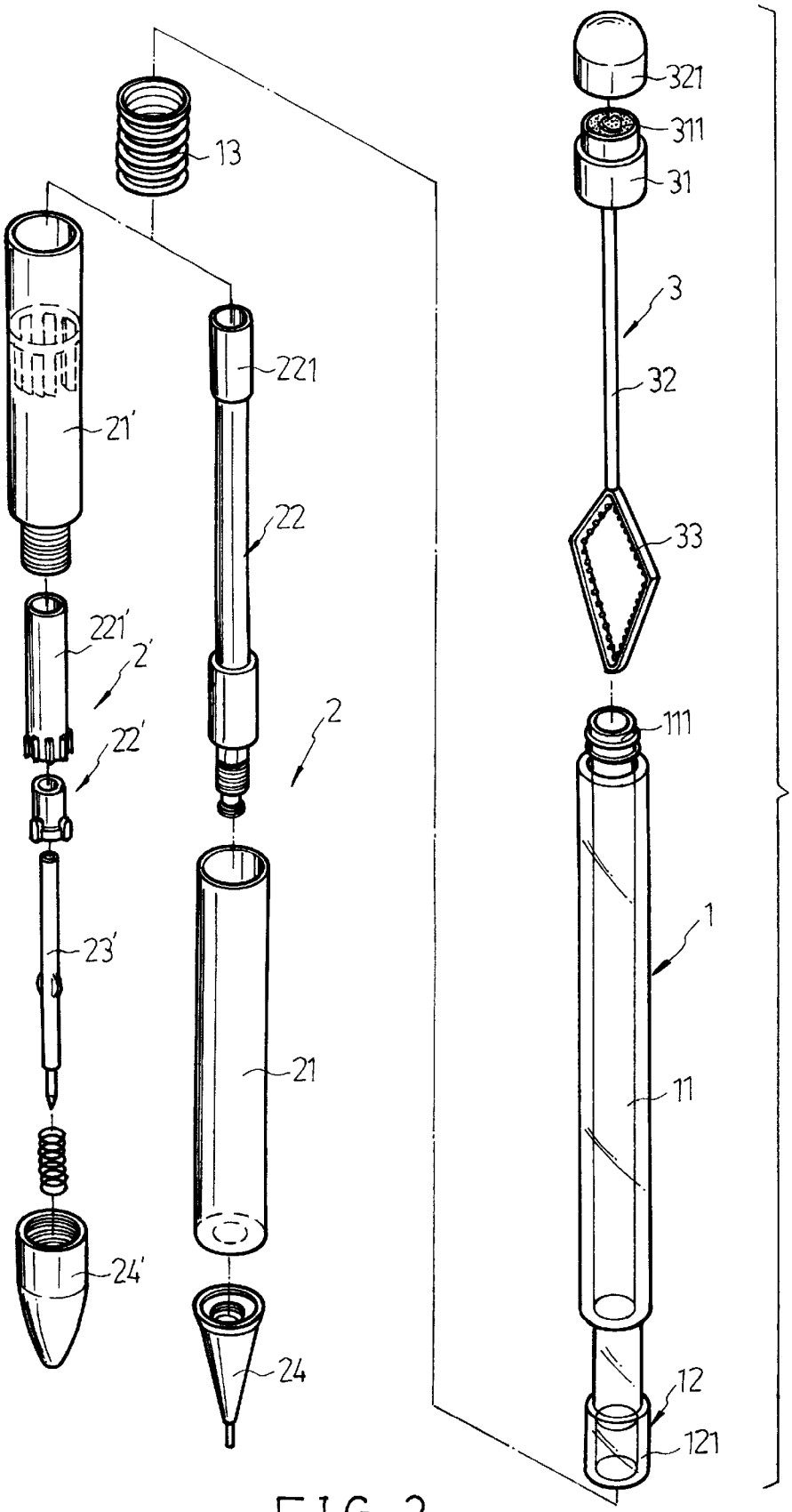
FIG. 3 is an exploded view of the first embodiment and second embodiment of the present invention.
Figure 4:
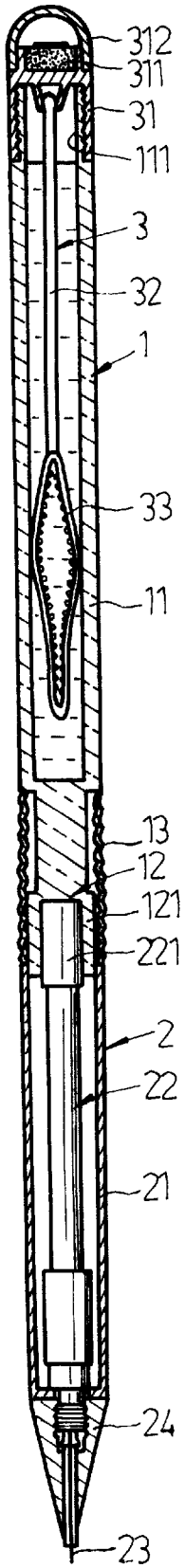
FIG. 4 is a longitudinal view in section of the first embodiment of the present invention.

Referring to FIGS. 1, 3 and 4, a combination bubble blower pen according to a first embodiment of the present invention is generally comprised of an upper barrel 1, a pen body 2, and a bubble-blowing device 3. The upper barrel 1 is fastened to one end, namely, the top end of the pen body 2. The pen body 2 is comprised of a penholder 21, a pencil lead holder 22, a pencil lead 23, and a tapered front socket 24. The pencil lead holder 22 is mounted in the penholder 21 and fixedly connected to the front socket 24, having a top open head 221 through which the pencil lead 23 is inserted into the pencil lead holder 22. Pressing the top open head 221 of the pencil lead holder 22 causes one pencil lead 23 to be propelled out of the front socket 24 for writing.

The upper barrel 1 is a cylindrical solution container holding a solution for producing bubbles, comprising a threaded neck 111 at one end, namely, the top end of the body 11 thereof, a bottom extension rod 12 axially forwardly extended from an opposite end, namely, the closed bottom end of the body 11, and a receptacle 121 on the bottom extension rod 2. The bubble-blowing device 3 comprises a cap-like head 31 holding a self-inking stamp 311, a flexible bubble coil 33, a shank 32 connected between the cap-like head 31 and the flexible bubble coil 33, and a cap 121 covered on the cap-like head 31. The cap-like head 31 holds a self-inking stamp 311. After insertion of the bubble-blowing device 3 into the upper barrel 1, the cap-like head 31 is threaded onto the threaded neck 111 to close the upper barrel 1. The top open head 221 of the pencil lead holder 22 extends out of the top end of the penholder 21, and coupled to the receptacle 121 at the bottom extension rod 12 of the upper barrel 1. The outer diameter of the receptacle 121 is smaller than the inner diameter of the barrel 21, so that the receptacle 12 can be moved with the upper barrel 1 in and out of the penholder 21. Further, a bellows tube 13 is sleeved onto the receptacle 121 and connected between the bottom end of the body 11 of the upper barrel 1 and the top end of the penholder 21. When the upper barrel 1 is lowered to force the receptacle 121 into the penholder 21, the top press head 221 of the pencil lead holder 22 is depressed, causing the pencil lead 1 to be propelled out of the front socket 24 for writing.

Figure 2:
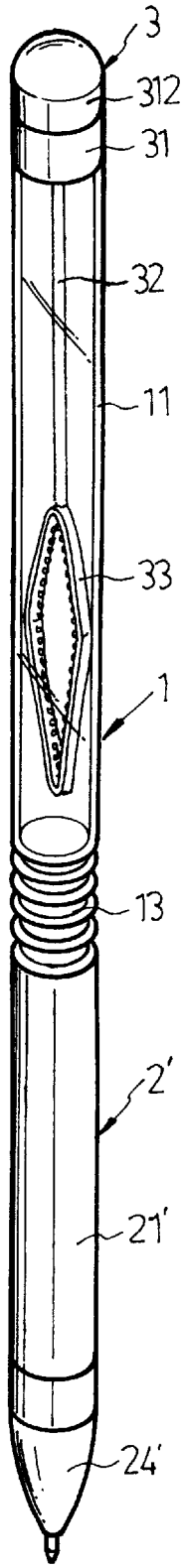
FIG. 2 is a perspective assembly view of a combination bubble blower pen according to a second embodiment of the present invention.
Figure 5:
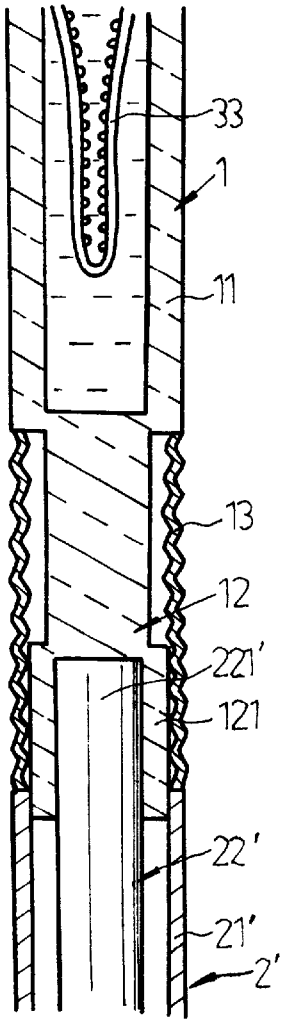
FIG. 5 is a longitudinal view in section in an enlarged scale of a part of the second embodiment of the present invention.

Referring to FIGS. 2, 3 and 5, this alternate form is a ball-point pen type combination bubble blower pen, comprised of an upper barrel 1, a pen body 2', and a bubble-blowing device 3. The upper barrel 1 and the bubble-blowing device 3 are identical to the corresponding members in the pencil type combination bubble blower pen shown in FIG. 1. The pen body 2' is comprised of a penholder 21', an ink cartridge holder assembly 22', an ink cartridge 23', and a tapered front socket 24'. The receptacle 121 of the upper holder 1 is coupled to the top end of the press head 221' of the ink cartridge holder 22'. The bellows tube 13 is connected between the bottom end of the body 11 of the upper barrel 1 and the top end of the penholder 21'. Pressing the upper barrel 1 downwards relative to the pen body 2' causes the receptacle 121 to be lowered with the upper barrel 1 into the inside of the penholder 21', and the ink cartridge 23' is propelled out of the front socket 24' by the ink cartridge holder assembly 2' for writing.

Figure 6:
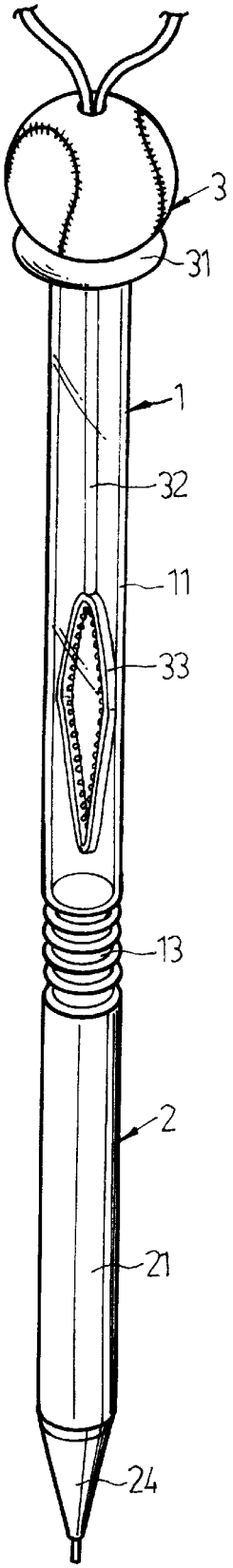
FIG. 6 is similar to FIG. 1 but showing an alternate form of the cap-like head for the bubble-blowing device.
Figure 7:
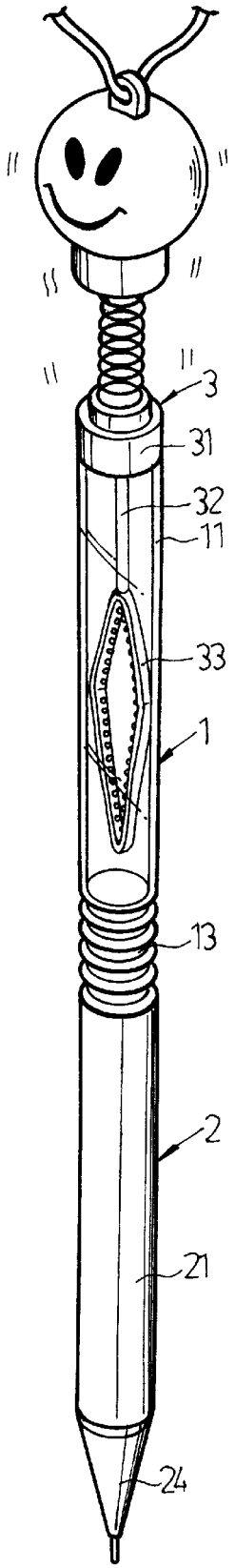
FIG. 7 is similar to FIG. 1 but showing another alternate form of the cap-like head for the bubble-blowing device.
Figure 8:
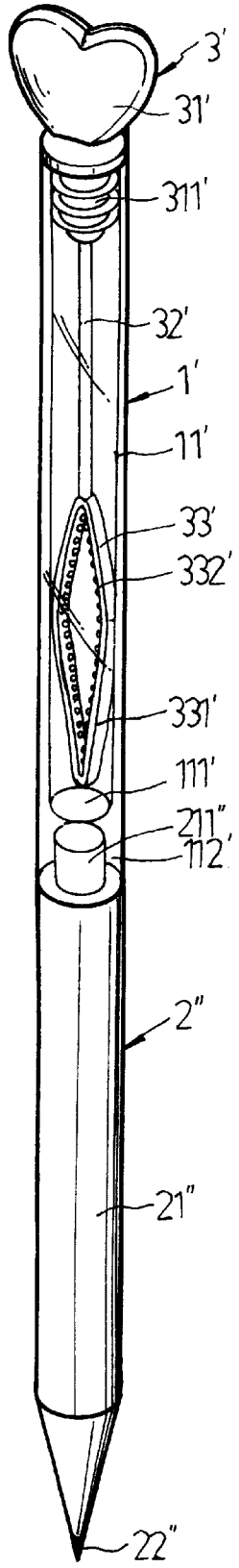
FIG. 8 is a perspective assembly view of a combination bubble blower pen according to a third embodiment of the present invention.

Referring to FIGS. 6 and 7, an ornamental device or spring toy may be formed integral with the cap 321.

Figure 9:
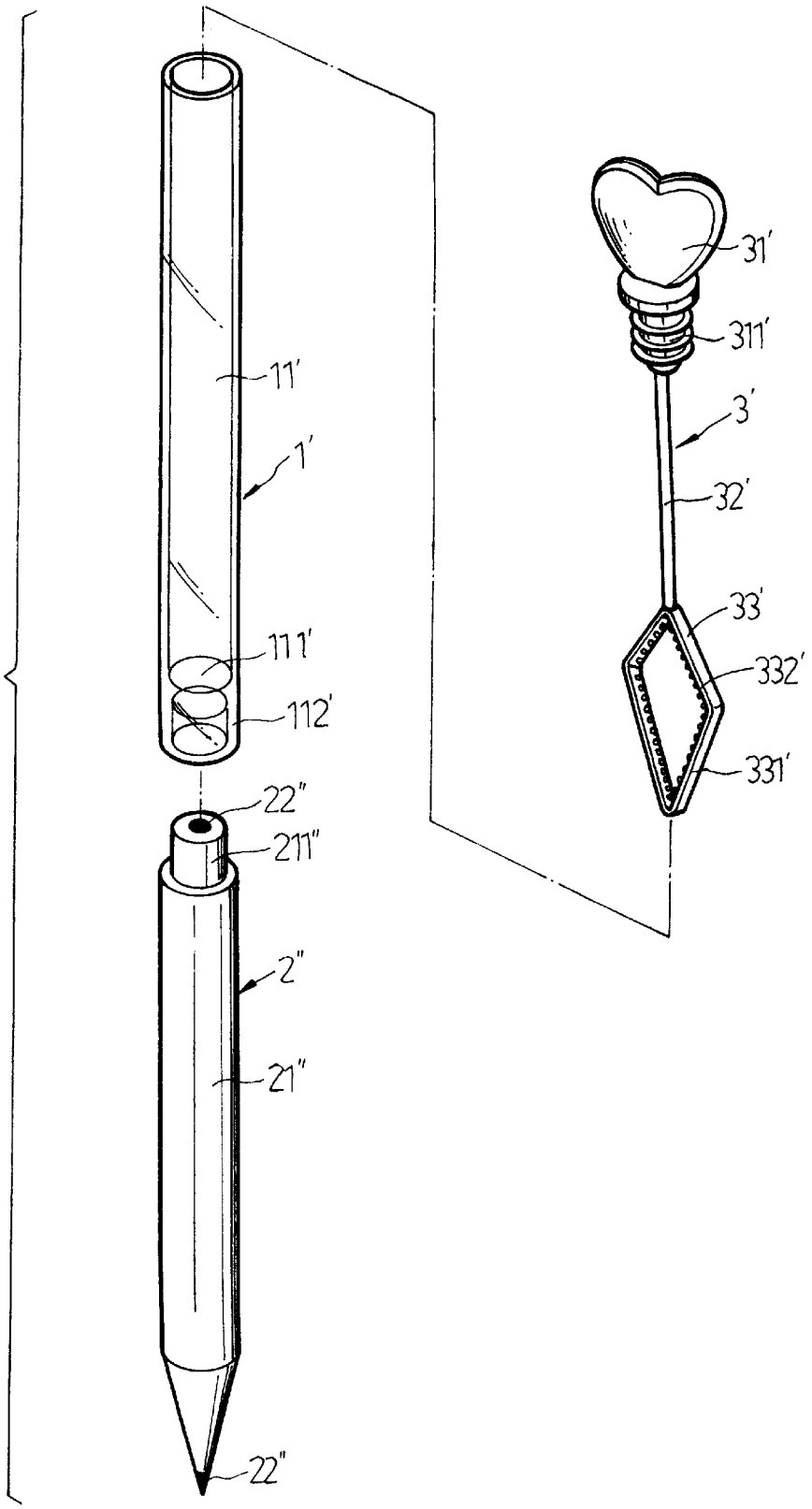
FIG. 9 is an exploded view of the combination bubble blower pen according to the third embodiment of the present invention.
Figure 10:
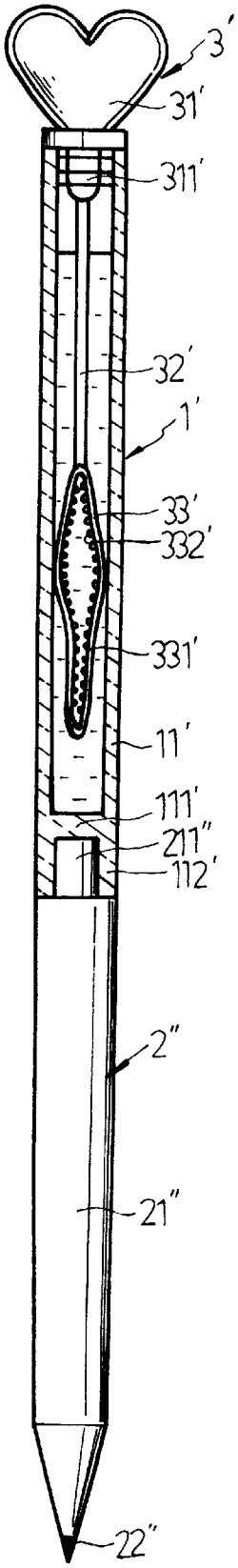
FIG. 10 is a sectional view of the combination bubble blower pen according to the third embodiment of the present invention.
Figure 11:
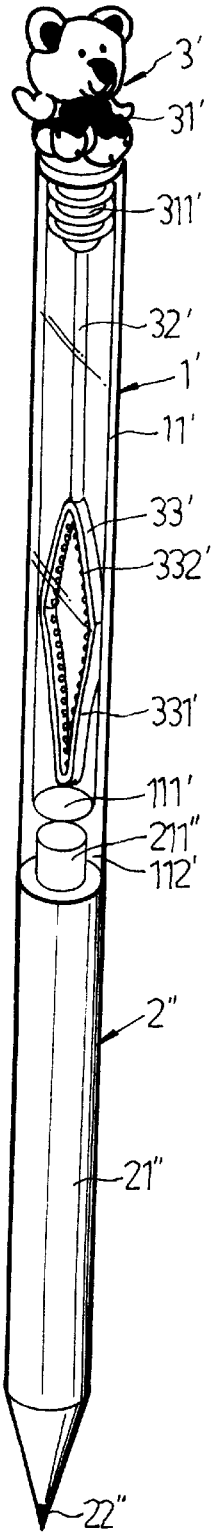
FIG. 11 is similar to FIG. 10 but showing an alternate form of the head for the bubble-blowing device.

FIGS. From 8 through 10 show another alternate form of the present invention. This alternate form of combination bubble blower pen is comprised of an upper barrel 1', a pen body 2", and a bubble-blowing device 3'. The pen body 2" is comprised of a penholder 21", a pencil lead 22". The upper barrel 1' has a receptacle 112' formed integral with the closed bottom end 111' of the body 11' thereof. The outer diameter of the upper barrel 1' is equal to the penholder 21" of the pen body 2". The penholder 21" has a top coupling neck 211" plugged into the receptacle 112". When assembled, the penholder 21" and the upper barrel 1" are peripherally disposed in flush with each other. The bubble-blowing device 3" comprises a head 31', a flexible bubble coil 33', and a shank 32' connected between the flexible bubble coil 33' and the head 31'. The head 31' has a plug portion 311' for plugging into the top open end of the body 11' of the upper barrel 1'. The flexible bubble coil 33' is shaped like a rhombic open frame comprised of a shorter upper ^-shaped part 332' and a longer lower V-shaped part 331'. The contained angle defined within the upper ^-shaped part 332' is greater than the contained angle defined within the longer lower V-shaped part 331'. Further, the head 31' may be variously shaped. In FIGS. 9 and 10, the head 31' has a heart-like shape. In FIG. 11, the head 31' is shaped like a bear.

It is to be understood that the drawings are designed for purposes of illustration only, and are not intended for use as a definition of the limits and scope of the invention disclosed.

What is claimed is:

1. A combination bubble blower pen comprising a pen body, an upper barrel connected to a top end of said pen body and holding a solution for producing bubbles, and a bubble-blowing device for insertion into said upper barrel to take said solution for blowing bubbles, wherein said pen body comprises a penholder having a top end and a bottom end, a tapered front socket connected to the bottom end of said penholder, a writing element holder mounted in said penholder and fixedly connected to said front socket, a writing element inserted into said writing element holder, said writing element holder having a top open head through which said writing element holder is depressed to propel said writing element out of said front socket for writing; said upper barrel comprises a receptacle extended from a bottom extension rod of a body thereof and coupled to the top open head of said writing element holder, and a bellows tube connected between a bottom end of the body thereof and the top end of said penholder for enabling said upper barrel to be moved relative to said penholder to depress the top open end of said writing element holder in propelling said writing element out of said front socket for writing.

* * * * *